US010268161B2

(12) United States Patent
Vuille

(10) Patent No.: US 10,268,161 B2
(45) Date of Patent: Apr. 23, 2019

(54) DIAL APPLIQUE FOR A TIMEPIECE

(71) Applicant: The Swatch Group Research and Development Ltd, Marin (CH)

(72) Inventor: Pierry Vuille, Les Emibois (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/380,367

(22) Filed: Dec. 15, 2016

(65) Prior Publication Data

US 2017/0176943 A1 Jun. 22, 2017

(30) Foreign Application Priority Data

Dec. 21, 2015 (EP) ..... 15201677

(51) Int. Cl.
*G04B 19/10* (2006.01)

(52) U.S. Cl.
CPC ..... *G04B 19/103* (2013.01)

(58) Field of Classification Search
CPC .... G04B 19/103; G04B 47/042; G04B 19/12; G04B 19/06; G04B 19/10; G04B 19/106; G04B 19/14; G04D 3/0048; A44C 15/004; A44C 17/0258; A44C 17/0275; G09F 7/06
USPC ..... 368/232, 236
See application file for complete search history.

(56) References Cited

U.S. PATENT DOCUMENTS 2,606,418 A * 8/1952 Fluckiger ..... G04B 19/103 368/232
6,404,704 B1 * 6/2002 Bossel ..... G04B 19/103 368/232
8,947,983 B2 * 2/2015 Stark ..... G04B 19/103 368/232

FOREIGN PATENT DOCUMENTS

CH 698 582 B1 9/2009
CH 706 110 A2 8/2013
FR 1078905 A * 11/1954 ..... G04B 19/103

OTHER PUBLICATIONS

European Search Report dated Jun. 22, 2016 in European Application 15201677.0, filed on Dec. 21, 2015 (with English Translation of Categories of cited documents).

* cited by examiner

*Primary Examiner* — Edwin A. Leon
(74) *Attorney, Agent, or Firm* — Oblon, McClelland, Maier & Neustadt, L.L.P.

(57) ABSTRACT

An applique intended to be affixed to a timepiece dial including at least one foot portion having a first end attached to the applique and a second, free end, the foot portion being arranged to be capable of insertion into a hole provided in the dial. The foot portion includes at least one aperture opening towards the exterior and forming a housing arranged to receive anchor for anchoring the foot portion to the dial, once the foot portion is inserted into the hole in the dial.

13 Claims, 1 Drawing Sheet

DIAL APPLIQUE FOR A TIMEPIECE

This application claims priority from European Patent application 15201677.0 of Dec. 21, 2015, the entire disclosure of which is hereby incorporated herein by reference.

FIELD OF THE INVENTION

The invention relates to the field of mechanical horology. It concerns, more particularly, an applique or applied chapter intended to be affixed to a timepiece dial, comprising at least one foot portion having a first end attached to the applique and a second, free end, the foot portion being arranged to be capable of insertion into a hole provided in the dial. The present invention also concerns a dial to which such an applique or applied chapter is affixed, and a method for securing such an applique on a dial.

BACKGROUND OF THE INVENTION

Appliques or applied chapters are the hour numerals or the symbols cut out of sheetmetal and then bonded or riveted to the dial. Appliques are provided with feet portions which are mounted on the dial in pre-formed drilled holes. Once in place, the foot portion is lapped and riveted, welded or glued inside the drilled holes. Riveting consists in pressing the free end of the foot portion inside the drilled hole, forcing it to enter the drilled hole to obtain a bonded joint. Riveting requires the application of a certain amount of force on the foot portion in order to deform the material, so this technique cannot be used for fragile dials.

To affix appliques by welding requires the selection of suitable materials, which limits the possible materials that can be used to make the appliques and the dial. For example, it is not possible to weld gold appliques onto a ceramic dial.

SUMMARY OF THE INVENTION

It is a particular object of the invention to overcome the various drawbacks of known techniques for assembling appliques or applied chapters on a dial.

More precisely, it is an object of the invention to provide an applique or applied chapter permitting simple assembly on the dial while ensuring an excellent hold.

It is another object of the invention to provide an applique that removes any constraints in the choice of materials for the dial and for the applique.

To this end, the present invention concerns an applique intended to be affixed to a timepiece dial, comprising at least one foot portion having a first end attached to the applique and a second, free end, the foot portion being arranged to be capable of insertion into a hole provided in the dial.

According to the invention, the applique foot portion comprises at least one aperture opening towards the exterior of the foot portion and forming a housing arranged for receiving anchor or means for anchoring the foot portion to the dial, once the foot portion is inserted into the dial hole.

The present invention also concerns a timepiece dial comprising at least one hole and at least one applique or applied chapter affixed to said dial, said applique comprising at least one foot portion having a first end attached to the applique and a second, free end, the foot portion being inserted into said hole. Said foot portion comprises at least one aperture opening towards the exterior and forming a housing receiving means for anchoring the foot portion to the dial.

The present invention also concerns a method for affixing an applique or applied chapter to a timepiece dial, said dial comprising at least one hole, said method comprising the steps of:

a) preparing an applique comprising at least one foot portion having a first end attached to the applique and a second, free end, the foot portion being arranged to be capable of insertion into the hole and comprising at least one aperture opening towards the exterior and forming a housing arranged for receiving means for anchoring the foot portion to the dial, b) inserting the foot portion of the applique into the hole in the dial, c) inserting anchoring means into the aperture in the foot portion and in contact with the dial to anchor the foot portion to the dial.

The invention makes it possible to achieve the secure fastening of an applique to a dial without constraints as to the choice of materials.

BRIEF DESCRIPTION OF THE DRAWINGS

Other features and advantages of the invention will appear more clearly upon reading the following description of an embodiment of the invention, given simply by way of illustrative and non-limiting example, and the annexed Figures, among which.

DETAILED DESCRIPTION OF A PREFERRED EMBODIMENT

Figure 1:
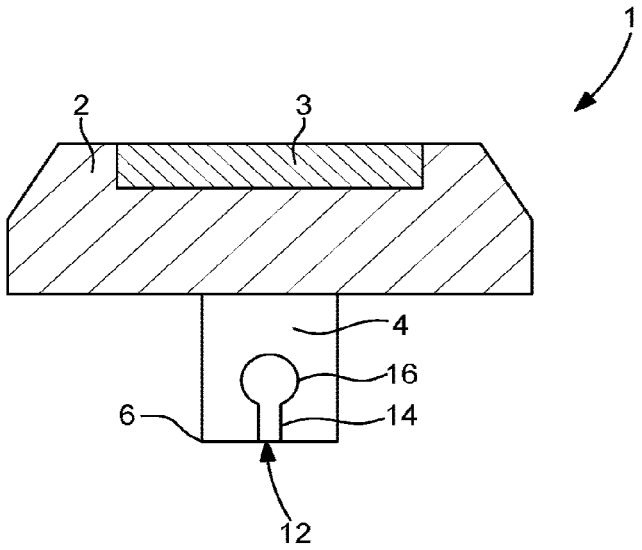
FIG. 1 represents a cross-sectional view of an applique according to the invention.

Referring to FIG. 1, there is represented an applique 1 intended to be affixed to a timepiece dial. In a conventional manner, applique 1 comprises a head 2 on which a symbol 3 is formed, such as a numeral for indicating the hour, or any other index. The head can form the actual symbol. The head may have various shapes and various dimensions, depending on the symbol to be affixed to the dial. Applique 1 also comprises at least one foot portion 4 having a first end attached to head 2 of applique 1, and a second, free end 6. Foot portion 4 is arranged and sized to be capable of insertion into a drilled bore or hole 8, preferably a through hole, provided in dial 10 for this purpose. The number of feet portions per applique may vary, essentially according to the dimensions and shape of the applique. Foot portion 4 may preferably have a circular cross-section, but any other suitable shape may be envisaged, hole 8 then preferably having a cross-section of complementary shape.

According to the invention, foot portion 4 comprises at least one aperture 12 opening towards the exterior and forming a housing arranged for receiving anchoring means 18 arranged to allow foot portion 4 to be anchored to dial 10, once foot portion 4 is inserted into hole 8 in dial 10.

Advantageously, aperture 12 may take the form of a cylindrical recess or of at least one slot 14, one end of which opens out at free end 6 of foot portion 4 and the other end of which flares out to form a housing 16 inside foot portion 4. Preferably, housing 16 is substantially spherical. Preferably, the cylindrical recess or slot 14 extends parallel to the longitudinal axis of foot portion 4.

Preferably, anchoring means 18 may comprise an adhesive or a melted metal deposited in aperture 12 and in contact with dial 10 so as to anchor foot portion 4 to dial 10.

Advantageously, foot portion 4 of applique 1 may have a height arranged to be greater than the height of hole 8 of dial 10 so that one part of foot portion 4 ending in free end 6 projects from hole 8. The height of foot portion 4 is the distance separating the first end thereof attached to the applique from the second, free end 6. All the heights used in the present description are distances taken parallel to the height of foot portion 4, along a longitudinal axis of said foot portion 4.

Preferably, aperture 12 has a height that ensures uniform filling of the aperture with the adhesive or melted metal. For example, when foot portion 4 has a height greater than the height of dial hole 8, the ratio of the foot portion height underneath aperture 12 (between the end attached to the applique and the base of aperture 12) to the height of hole 8 inside dial 10 should be considered case by case, but is preferably close to 1.

Figure 2:
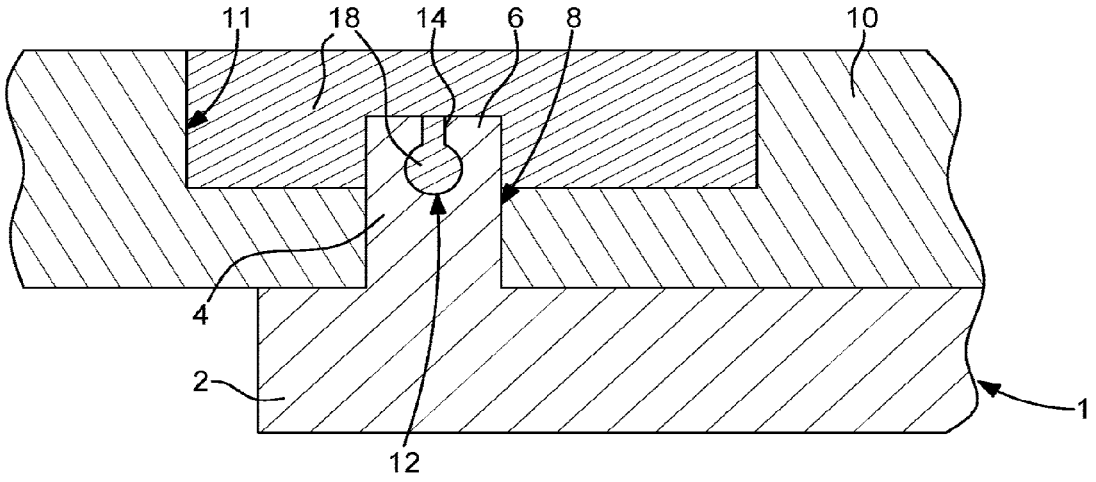
FIG. 2 is a cross-sectional view of the dial to which the applique of FIG. 1 has been affixed.

According to a preferred variant represented in FIG. 2, dial 10 may comprise at least one recess 11 inside which hole 8 is formed and into which it opens. Hole 8 is a through hole so that the height of hole 8 is substantially equal to the height of dial 10 remaining underneath recess 11.

Anchoring means 18, such as the adhesive or melted metal, are then deposited inside aperture 12 and inside recess 11 to anchor foot portion 4 to dial 10. Once deposited, the anchoring means inserted both into the foot portion aperture and into the dial recess allow said foot portion to be joined to said dial. Preferably, the adhesive or melted metal is deposited such that it entirely fills aperture 12 and recess 11 so that free end 6 of the foot portion is not visible and so that foot portion 4 is embedded in dial 10 and does not project from the overall surface of dial 10. Dial 10 thus appears to be substantially planar.

It is clear that the number, shape and position of aperture 12 can be adapted to optimise the anchoring of foot portion 4 to dial 10, the essential point being that aperture 12 provided at the external surface of foot portion 4 can be connected to the dial by the anchoring means. In the variant with a recess, aperture 12 communicates with the space formed by recess 11.

Aperture 12 can be made at any point on the periphery of foot portion 4 between the end thereof attached to the applique and free end 6, and at the base of free end 6.

Aperture 12 may take the form of a simple hole forming a housing, or any other suitable shape allowing a housing to be formed for receiving the anchoring means. For example, aperture 12 may take the form of a thread made on the periphery of the foot portion. Such an aperture shape can increase the contact area between foot portion 4 and the anchoring means such as the adhesive. Better adhesive bonding and a better hold of foot portion 4 is thus obtained.

The present invention also concerns a method for affixing an applique or applied chapter 1 to a timepiece dial 10, said dial 10 comprising at least one hole 8, said method comprising the steps of:

a) preparing an applique 1 comprising at least one foot portion 4 having a first end attached to applique 1 and a second, free end 6, foot portion 4 being arranged to be capable of insertion into hole 8 in dial 10 and comprising at least one aperture 12 opening towards the exterior and forming a housing arranged for receiving means for anchoring foot portion 4 to dial 10, b) inserting foot portion 4 of applique 1 into hole 8 of dial 10, c) inserting anchoring means into aperture 12 in foot portion 4 and in contact with dial 10 to anchor foot portion 4 to dial 10.

When the anchoring means comprise an adhesive or a melted metal deposited inside aperture 12 and in contact with dial 10 to anchor foot portion 4 to dial 10, the method of the invention comprises an additional step d) consisting in allowing the adhesive or melted metal to solidify to join foot portion 4 and dial 10.

In the variant wherein dial 10 comprises at least one recess 11 inside which hole 8 is formed, preferably having a height equal to the height of dial 10 underneath recess 11, anchoring means 18 are inserted into aperture 12 of foot portion 4 and into recess 11 to anchor foot portion 4 to dial 10. Preferably, foot portion 4 has a height greater than the height of hole 8 so that its free end 6 projects from hole 8 of dial 10. Thus, the end of foot portion 4 projecting from hole 8 and opening into recess 11 is embedded for example in the adhesive deposited inside recess 11, to ensure improved securing of foot portion 4 to dial 10, as shown in FIG. 2.

In the present invention, the aperture provided at the free end side of the applique foot portion makes it possible for anchoring means, such as an adhesive, to be inserted therein, and for the applique to be assembled on the dial without requiring application of excessive force. The dial is therefore protected.

Employing an adhesive as the anchoring means also means that appliques can be used with no constraints as to the choice of materials.

What is claimed is:

1. An applique intended to be affixed to a timepiece dial, comprising:

at least one foot portion having a first end attached to the applique and a second, free end, the foot portion being arranged to be capable of insertion into a hole provided in the dial, wherein said foot portion includes at least one aperture including at least one slot and at least one housing, one end of the at least one slot opening on a surface of a distal end of the second end and the other end of the at least one slot being connected with the at least one housing receiving anchor for anchoring the foot portion to the dial once the foot portion is inserted into the hole in the dial, a width of the at least one housing being greater than a width of the at least one slot.

2. The applique according to claim 1, wherein said foot portion has a height arranged to be greater than the height of the hole.

3. The applique according to claim 1, wherein the slot extends parallel to a longitudinal axis of the foot portion.

4. The applique according to claim 1, wherein the anchor includes an adhesive or a melted metal.

5. A timepiece dial or timepiece comprising at least one applique comprising:

at least one foot portion having a first end attached to the applique and a second, free end, the foot portion being arranged to be capable of insertion into a hole provided in the dial, said foot portion including at least one aperture including at least one slot and at least one housing, one end of the at least one slot opening on a surface of a distal end of the second end and the other end of the at least one slot being connected with the at least one housing receiving anchor for anchoring the foot portion to the dial once the foot portion is inserted into the hole in the dial, said applique being affixed to said dial, a width of the at least one housing being greater than a width of the at least one slot.

6. A timepiece dial comprising:

at least one hole and at least one applique affixed to said dial, said applique including at least one foot portion having a first end attached to the applique and a second, free end, the foot portion being inserted into said hole, wherein said foot portion includes at least one aperture including at least one slot and at least one housing, one end of the at least one slot opening on a surface of a distal end of the second end and the other end of the at least one slot being connected with the at least one housing receiving anchor for anchoring the foot portion to the dial, a width of the at least one housing being greater than a width of the at least one slot.

7. The dial according to claim 6, wherein the dial includes at least one recess inside which is formed said hole, and wherein the height of the hole is equal to the height of the dial underneath the recess.

8. The dial according to claim 6, wherein the foot portion has a height greater than the height of the hole.

9. The dial according to claim 6, wherein the slot extends parallel to a longitudinal axis of the foot portion.

10. The dial according to claim 6, wherein the anchor includes an adhesive or a melted metal deposited inside the aperture and in contact with the dial to anchor the foot portion to the dial.

11. A method for affixing an applique to a timepiece dial, said dial comprising at least one hole, said method comprising:

preparing an applique including at least one foot portion having a first end attached to the applique and a second, free end, the foot portion being arranged to be capable of insertion into the hole in the dial and including at least one aperture including at least one slot and at least one housing, one end of the at least one slot opening on a surface of a distal end of the second end and the other end of the at least one slot being connected with the at least one housing arranged to receive anchor for anchoring the foot portion to the dial, a width of the at least one housing being greater than a width of the at least one slot;

inserting the foot portion of the applique into the hole in the dial; and inserting anchor into the aperture in the foot portion and in contact with the dial to anchor the foot portion to the dial.

12. The method according to claim 11, wherein the anchor includes an adhesive or melted metal deposited inside the aperture and in contact with the dial so as to anchor the foot portion to the dial.

13. The method according to claim 11, wherein the dial includes at least one recess inside which is formed said hole, and wherein the anchor is inserted into the aperture in the foot portion and into the recess to anchor the foot portion to the dial.

* * * * *